US009129582B2

(12) United States Patent
Siwko

(10) Patent No.: US 9,129,582 B2
(45) Date of Patent: Sep. 8, 2015

(54) MASTER SOUND POST GAUGE

(76) Inventor: Karol Siwko, Ocala, FL (US)

( * ) Notice: Subject to any disclaimer, the term of this patent is extended or adjusted under 35 U.S.C. 154(b) by 376 days.

(21) Appl. No.: 13/370,249

(22) Filed: Feb. 9, 2012

(65) Prior Publication Data

US 2013/0139669 A1 Jun. 6, 2013

Related U.S. Application Data

(60) Provisional application No. 61/565,609, filed on Dec. 1, 2011.

(51) Int. Cl.
*G10D 1/02* (2006.01)
*G10D 3/00* (2006.01)

(52) U.S. Cl.
CPC ... *G10D 1/02* (2013.01); *G10D 3/00* (2013.01)

(58) Field of Classification Search
CPC ..... G10D 1/00; G10D 3/00; G10D 3/02; Y10T 29/49574; G10G 5/00
USPC ..... 84/267, 274, 277
See application file for complete search history.

(56) References Cited

U.S. PATENT DOCUMENTS

| | | | | |
|---|---|---|---|---|
| 1,466,681 | A * | 9/1923 | Todd | 84/277 |
| 5,208,408 | A * | 5/1993 | Cave | 84/277 |
| 6,482,239 | B1 * | 11/2002 | Jones et al. | 84/458 |
| 2013/0020367 | A1 * | 1/2013 | Buckley | 224/584 |

FOREIGN PATENT DOCUMENTS

JP 2003235872 A * 8/2003 ..... A61C 8/00

* cited by examiner

*Primary Examiner* — Kimberly Lockett

(57) ABSTRACT

The invention helps build a practical telescopic gauge to measure length and end angles needed for sound post in stringed instrument. It shows improvements of telescopic type gauge where, first adding a spring to control force while extending or reducing length and second adding rounded members at least one end of the gauge overcome difficulties in measuring the length. Further a three part swivel end consisting of ball, swivel cap and resolution plate held together by magnetic force allow satisfactory angle measurement. Because magnetic force is used, the swivel end parts can be removed leaving rounded ball end open for length measurements, then other components are added as required. This type of swivel end is also useful in improving currently available caliper type gauge.

14 Claims, 8 Drawing Sheets

MASTER SOUND POST GAUGE

CROSS REFERENCE TO RELATED APPLICATIONS

This application claims the benefits of U.S. Provisional Patent Application No. 61/565,609 filed on Dec. 1, 2011 which is incorporated by reference herein.

FIELD OF THE INVENTION

This invention relates to providing means of measuring the size and shape of violin Sound Post.

Violin Sound Box

FIG. 1 shows cross section inside Violin Sound Box.

Main components of a violin and other similar string instrument include the Sound box, Finger board, Strings and Bridge. Tone or pitch of the sound is controlled by pressing the string against the finger board thus changing the effective length of the string. String is made to vibrate by plucking or bowing it transfers the sound through the Bridge (1) to the top acoustic plate and (2) (the Belly) of the Sound Box. This said Sound Box amplifies and projects the sound. The inside of the top plate (Belly) of the sound box is reinforced by a Bass Bar (3) permanently glued under the bass side of the bridge. The Sound Post (4) is inserted inside the Sound Box, between the top and bottom acoustic plates, under the treble leg of the bridge. This strengthens the violin and transfers sound vibrations to the bottom plate (5) (Back). Because the belly and the back of violin are not parallel, the required length of the sound post depends on the position in which it needs to be placed. Angle at each end of the Sound Post also needs to conform to contour of the Sound Box. Position of the Sound post has a great effect on quality of sound. Thus proper sound post design is critical.

RELATED PRIOR ART

There is a caliper type Violin Sound Post Gauge. Part of the gauge may be inserted into violin Sound Box, and adjusted to measure distance between Top and Bottom. This can be used to find the length of the sound post required for this instrument. No Known patents.

FIG. 2 illustrates construction of currently available caliper type gauge. The gauge has two arms, offset in such way, that they can be introduced inside the sound box via F hole. Once in the desired position, the arms of the gauge are moved away from each other until they stretch between the belly and back of the sound box. The tool is then locked and withdrawn showing the length necessary for the new sound post.

SUMMARY

This invention provides improved means for measuring the length of the sound post and provides means to measure the angle of each end of the sound post, thus to ensure firm contact with belly and back of the violin sound box. First, a special Adjustable telescopic Gauge is set longer than expected length of Sound Post. This Gauge is also made such, that it can be reduced in length to fit between the Belly and Back of the violin. It will retain this desired length until it is removed and measured.

At least one end of this said Gauge may also include a swivel type member, such that, while under pressure, it can change its angle and assume position parallel to the plate it is touching.

Further, a part of this invention is used to enhance performance of currently available gauge or to redesign this gauge with improvements.

Master Sound Post Gauge options.

DETAILED DESCRIPTION OF NEW INVENTION

Principle of Operation

Figure 3:
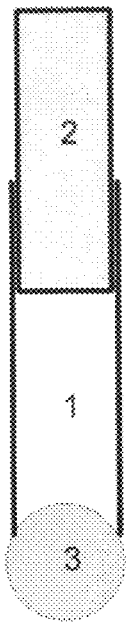
FIG. 3 Telescopic sound post gauge.
Figure 6:
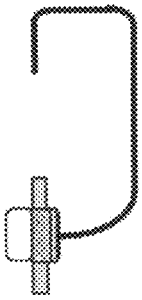
FIG. 6 Inserting tool for gauge

FIG. 3 shows a practical approach to measure required length of the Sound Post. Here a gauge simulating sound post is used and is introduced into the Violin Sound Box using a Sound Post Inserting/Removing Tool (FIG. 6). The basic Sound Post Gauge (FIG. 3) consists of at least two parts, a tube (1) and inner cylinder (2) that can slide against each inside the tube other and are held together Sliding action is controlled by friction. Additionally a rounded element, like a ball (3) is added to one end of the gauge making it easier it easier to slide along surface inside the instrument sound box.

Practical Approach

Optionally (FIG. 4) a spring wire (2) or ribbon is bent and inserted into outer cylinder a tube (1) and is made to slide up and down relative to the tube; this assembly again can acquire and hold the required dimension after achieving contact with the belly and back of violin sound box. This forms Basic Gauge. Basic gauge is improved by adding more elements: Adding a rounded member, like a ball (3) to the free end of at least one of two gauge elements will help the gauge slide smoothly inside the violin sound box thus making it easier possible to set in correct position.

The assembly In practical application telescopic gauge is first expanded to a length slightly longer than that required for new Sound Post. When introduced into the Violin Sound Box using inserting tool (FIG. 6) and maneuvered into desired position, when in contact with Belly and Back of the Sound Box, the two members will be closed to the desired length and stay in this condition upon withdrawal. This means cylinder (2) and outer tube (1) of the gauge need to slide relatively easily against each other yet, when withdrawn gauge must retain Its current length. For optimum performance additional friction controlling element is added.

Figure 5:
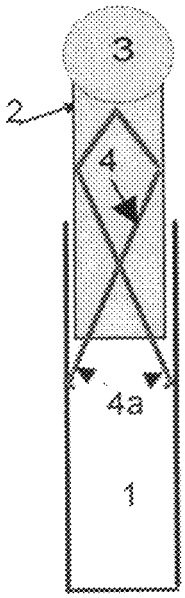
FIG. 5 improved gauge

FIG. 5 shows further improvements of such telescopic type assembly consisting of 4 elements. First part is tube (1). Second part a hollow cylinder (2) is inserted and slides inside the tube (1) to make up telescopic gauge. Third part, a round element, (can be a ball 3) is attached to at least one end of the gauge to allow smooth movement when the end slides against inside the sound box of musical instrument. Fourth part is flexible element, here a spring (4) is permanently held inside hollow cylinder (2) and extends (4*a*) beyond end of this cylinder to apply controlled pressure against inner wall of outer tube (1), thus controlling friction between two cylinders.

This forms Improved Telescopic Gauge which consists of a tube (1), cylinder (2), rounded element (3) and friction spring (4).

Additional element like a ball or a swivel can also be added to remaining free end of the gauge.

This forms Functionally Improved Gauge.

Swivel Ends

Figure 7:
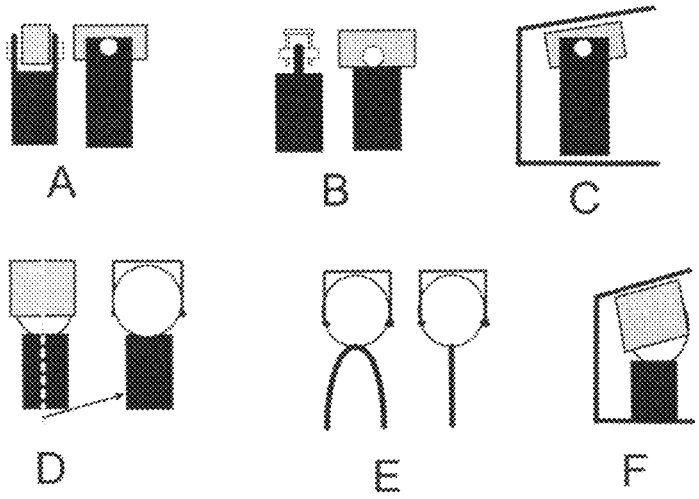
FIG. 7 Typical methods of providing swivel at each end of the post

The usefulness of this type of Sound Post Gauge is further enhanced by adding swivel member at least one end of the now improved Gauge. Because the belly and back of violin are not parallel, the swivel end will measure the angle at which each end of the sound post needs to be cut, thus ensure proper fit of the sound post inside the sound box. FIG. 7 shows typical options for building a swivel end. A and B show variations of a bar attached to the end of corresponding member. C shows how this would deflect by contact with a plate. D shows how a ball can be attached to the sliding rod; a properly fitted cap will deflect when in contact with an angled plane. E shows a special case where a preformed spring wire is utilized as second sliding arm of the Gauge.

Using Swivel Bar as in (FIG. 7-A) to Measure Angle.

Complete gauge with bar swivel end (FIG. 11-A) includes Improved Telescopic Gauge consisting of a tube (1), cylinder (2), rounded element (3) and friction control spring (4). Swivel consisting of flexible rod (5) with a slot includes a swivel bar (6) which rotates around a pin (5*b*) and is attached inside the slot. Walls at the slot of the rod apply sufficient pressure to the bar to resist free movement of the swivel bar. This is now attached to the free end of the gauge (FIG. 11A) allowing the gauge to measure angle.

Ball Swivels

Figure 8:
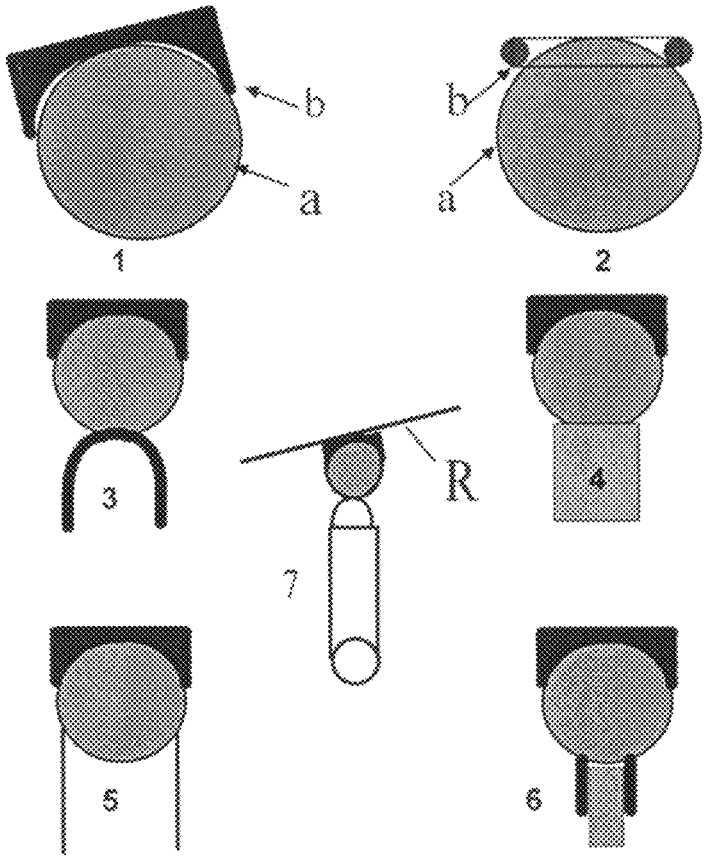
FIG. 8. Ball and Cap swivels.

FIG. 8-*a* Describes preferred configuration method in more detail. Here 1*a* demonstrates a ball made of magnetic material (such as steel) and a magnetized cap b attached and held by magnetic force. Magnetized means either solid magnet or having a built in magnet, thus acting like a magnet. The cap magnet will stay attached to the ball and can slide easily along the surface of the ball, thus acquiring variable angle relative to the rest of the assembly. FIG. 8 Detail 2 shows a magnet in form of a ring. Because dimensions of sound post are relatively small, using a magnet cap or ring makes it possible to attach a metallic plate 7R, which makes it easier to read the angle. (FIG. 8-7) shows BALL SWIVEL SET which consists of 2 or more parts: Ball, Cap and may include Resolution Plate, held together by magnetic force.

RESOLUTION PLATE FIG. 8 detail 7R is a thin metal strip, selected to have weak magnetic properties; it can be attached to the magnetic cap of the Gauge, yet when disturbed, will not force change in position of the magnetic cap. This forms enhanced swivel set.

The ball can be attached to the tube, rod or spring using any standard method, either welding or bonding, Details 3, 4, 5 and 6.

How it works.

Figure 9:
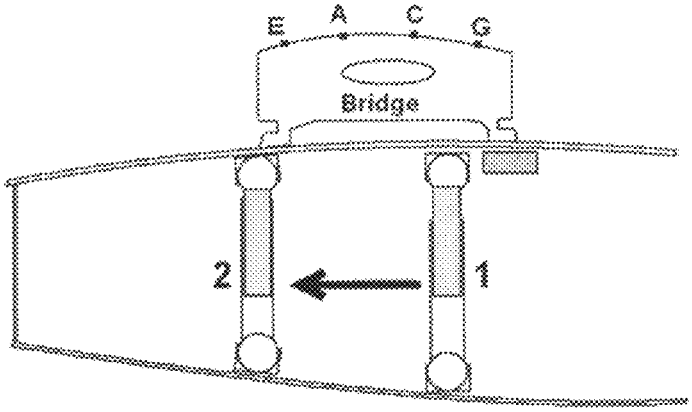
FIG. 9. Sound post master simulator inside violin sound box.

Demonstrates procedure; FIG. 9. First, the Gauge is extended to be slightly longer than expected final length of the sound post. Second, using the sound post inserter it is introduced into the highest portion (1) inside violin sound box. Third, it is maneuvered carefully to the required position (2), where it will assume proper dimensions. Finally it is carefully withdrawn and its measurements used for final sound post trimming of the new sound post. For accuracy length is measured with swivel ends removed, then swivels are added and each angle is measured separately. In most cases only one swivel is used, first angle at one side is measured and the gauge is reversed to measure second side.

Figure 11:
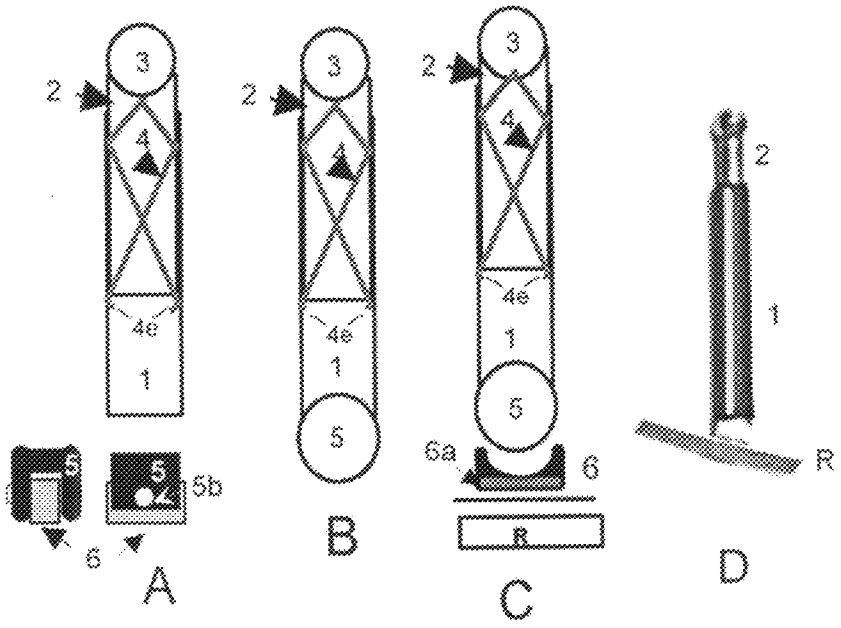
FIG. 11 Master Sound Post Gauge.

FIG. 11 shows options used to produce quality gauge for stringed musical instruments, FIG. 11A includes Functionally Improved Gauge as in FIG. 3B and a swivel bar (A-5) that can be attached to the free end of the gauge.

FIG. 11-B shows the gauge where a rounded element (5) is added at the second free end of the gauge, resulting in a gauge having rounded element (3) at free end of inner cylinder and rounded element (5) at free end of outer tube. Having rounded element at both ends allows the gauge to be easily maneuvered inside the sound box of stringed instruments. The shape of each rounded element is determined by optimum method to attach to the tube.

Preferred case (FIG. 11B) where each rounded element (3 and 5) is a ball.

Design of the gauge is enhanced by making each ball from magnetic material (such as steel). This (FIG. 11C) allows a magnetized cap (6) to be attached to at least one ball (5) end. The cap (6) is flat on one side while other side has indentation to match the contour of the ball (5). While connected to the ball, the cap when pressed against any surface will swivel at the ball to assume angle of the surface. When the gauge is withdrawn, the cap will retain the assumed angle. Since the magnetized cap is removable, distance (length) inside stringed instrument sound box can be measured more accurately without the cap, while cap is added for angle measurement.

Figure 1:
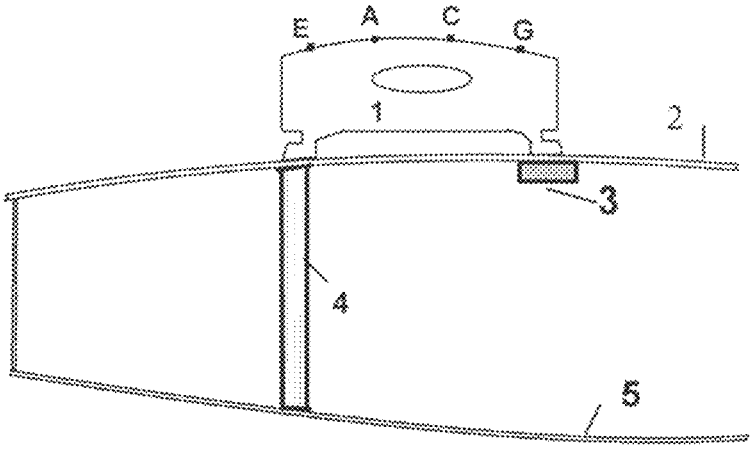
FIG. 1 Violin Sound Box cross section.
Figure 2:
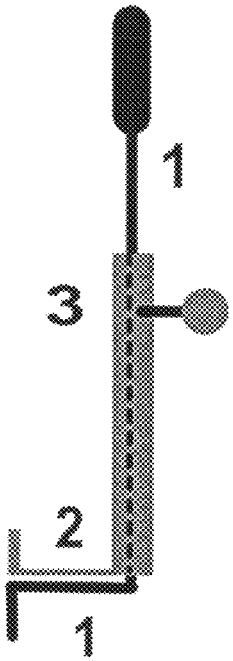
FIG. 2 Currently available Sound Post Gauge

FIG. 8-1 The magnetized cap (b) can be a magnet formed to match the contour of the ball (a). FIG. 8-2 has the cap as a ring magnet matched to steel ball (a). FIG. 11C The cap (6) is formed from other suitable material, magnetic or non magnetic, and stay magnetized by embedded magnet (6*a*).

A ring magnet (FIG. 5-2*b*) also makes a suitable cap.

Resolution Plate

The relatively small diameter of the cap makes it hard to resolve the angle at the face of the cap. This is where resolution plate is added.

FIG. 11C and FIG. 8-7R Resolution plate is a thin metal strip, selected to have weak magnetic properties; it can be attached to the magnetized cap of the Gauge, yet when disturbed, will not force change in position of the cap, in this way it clearly exposes the angle of the cap (FIG. 11D).

Two magnetized caps may be used, one at each end of the gauge. Although redundant, this can prove useful in instruments with tight F-hole at the sound box in musical instrument. Here the second ball and cap can be made smaller. Alternatively gauge as in FIG. 11C can be changed where the ball at each end is a magnet and swivel caps are made from magnetic material.

Existing Caliper Sound Post Gauge

FIG. 8 shows typical Swivel that can be attached to existing sound post Caliper gauge. Any type of swivel can be made to attach to the existing gauge; may be either properly designed or simply tied or taped to the gauge. Typical ball assembly shown in FIGS. 8-6, where ball is attached to a short length of tubing is made to fit the dimensions of the existing gauge.

Figure 10:
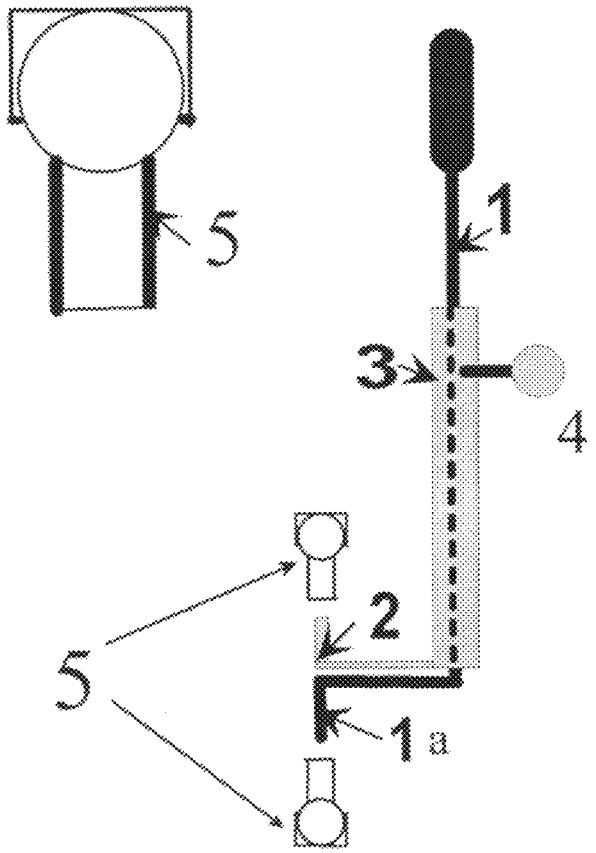
FIG. 10 Swivel ends that can be used with existing Sound Post Gauge.

Existing caliper gauge (FIG. 10) consists of handle (1) formed to have lower arm (1*a*) offset to reach inside string instrument sound box and outer sliding member (3) having upper arm with the same offset. Measurement is done by sliding outer member (3), thus to move arms to contact measured surfaces, then lock two members (3 and 1) by threaded screw (4). This gauge can be improved by adding swivel set (5) including a tube with attached steel ball and including removable magnetized cap, wherein the tube size can be fitted for mounting at one or both arms of the existing caliper gauge, thus to enable the gauge to measure angle inside stringed instruments.

Figure 4:
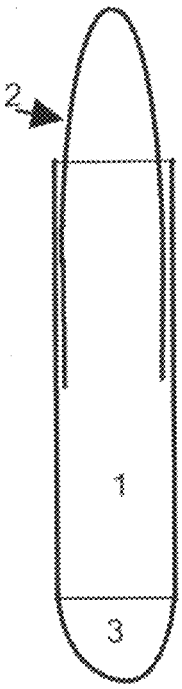
FIG. 4 simple gauge

FIG. 3 and FIG. 4 show a telescopic gauge consisting of 3 or more parts wherein first part is a tube and second part is a flexible element which can be a cylinder of smaller diameter FIG. 3-3 or a looped spring FIG. 4-2 held inside the first cylinder tube by friction. and rounded, and substantially smooth element is permanently attached to external free end of the gauge. This shows that although this type gauge requires 4 elements each performing a different function, it is made with 3 elements by making one of the elements perform two functions.

Improved Caliper Gauge

The existing Caliper Gauge can also be redesigned to accept swivels

The invention claimed is:

1. A Measuring gauge for string musical instruments consisting of a tube and a hollow cylinder having one end inserted to slide inside said tube thereby forming a telescopic gauge with two ends, a tube end and a cylinder end, a third element, said third element is rounded and substantially smooth; and is fixed to an external one of said two ends of said gauge, a fourth part is a flexible spring permanently secured inside said hollow cylinder and extended to contact and apply controlled pressure to an inside wall of said tube.

2. A measuring gauge for string musical instruments as in claim 1 wherein a swivel is attached to a remaining free end of the gauge wherein the swivel, when pressed against any surface will rotate to retain angle parallel with that surface.

3. A measuring gauge for string musical instruments as in claim 2 wherein the swivel consists of a rod with a slot and includes a swivel bar which rotates around a pin inside the slot wherein the walls of the slot apply sufficient pressure to the bar to prevent free movement of the swivel bar.

4. A measuring gauge for stringed musical instruments as in claim 1 wherein an additional element having a rounded and a substantially smooth end is fixed to an external free end of said gauge; said gauge having rounded smooth members at each free end of the gauge.

5. Means of improving an existing caliper type gauge; said gauge comprising a swivel set, wherein a swivel set includes, a tube with an attached steel ball and a removable magnetized cap, wherein the tube size can be fitted for mounting at one or both ends of the existing caliper gauge, to enable the gauge to measure an angle inside stringed instruments.

6. A Gauge for stringed musical instruments as in claim 4 wherein each rounded element is a ball.

7. A Gauge for stringed musical instruments as in claim 6 wherein each ball is made of magnetic material suitable to accept a magnetized cap.

8. A Gauge for stringed musical instruments as in claim 6 wherein a removable magnetized cap is attached to at least one ball end of the gauge, said cap having one flat side and the other side has an indentation to match a contour of the said ball, said cap when pressed against any surface will swivel at the ball to assume an angle parallel to the surface, when the gauge is withdrawn the cap will retain the assumed angle.

9. A Gauge for stringed musical instruments as in claim 8 wherein the cap is a magnet.

10. A Gauge for stringed musical instruments as in claim 8 wherein the cap is formed from suitable material and magnetized by embedded magnet.

11. A Gauge for stringed musical instruments as in claim 8 wherein the cap is a magnet in the form of a ring.

12. A Gauge for stringed musical instruments as in claim 8 including a resolution plate wherein said resolution plate is a thin metal strip selected to have weak magnetic properties, and can be attached to the magnetized cap of the Gauge, and when disturbed, will not force a change in position of the cap, said resolution plate while attached to the cap exposes the angle of the cap.

13. Gauge for stringed musical instruments as in claim 6 wherein at least one ball is a magnet suitable to accept a cap made from magnetic material.

14. Measuring gauge for string musical instruments consisting of a tube and a flexible element having one end inserted to slide inside said tube, thus forming a telescopic gauge with two ends, a third element is round and substantially smooth and is fixed to external free end of one of said two ends of said gauge.

* * * * *